United States Patent [19]

Scharsig

[11] 4,434,694

[45] Mar. 6, 1984

[54] FOOD MATERIAL SLICING MACHINE

[75] Inventor: Hans-Hermann Scharsig, Offenburg, Fed. Rep. of Germany

[73] Assignee: Hobart Corporation, Troy, Ohio

[21] Appl. No.: 356,871

[22] Filed: Mar. 10, 1982

[30] Foreign Application Priority Data

Apr. 4, 1981 [DE] Fed. Rep. of Germany ..... 3113638

[51] Int. Cl.[3] ..... B26D 7/06

[52] U.S. Cl. ..... 83/411 R; 83/408; 83/437; 83/733

[58] Field of Search ..... 83/717, 411 R, 411 A, 83/437, 408, 733, 350

[56] References Cited

U.S. PATENT DOCUMENTS

| | | | |
|---|---|---|---|
| 2,246,589 | 6/1941 | Hoe | 83/437 |
| 3,693,684 | 9/1972 | Bettcher | 83/733 |
| 3,782,230 | 1/1974 | Bettcher | 83/733 X |

*Primary Examiner*—Donald R. Schran

*Attorney, Agent, or Firm*—Biebel, French & Nauman

[57] ABSTRACT

A food material slicing machine has a housing, a cutter mounted in the housing, a hopper pivotally mounted to the housing for receiving food material when the hopper is in a first position remote from the cutter and being pivotable to a second position in alignment with the cutter so that the food material in the hopper can be fed to the cutter, and a cutter cover plate connected to the hopper for movement with the hopper for covering the cutter when the hopper is in the first position, where it is loaded with food material, and for uncovering the cutter when the hopper is moved to the second position in alignment with the cutter. An actuator is mounted to the hopper for use in manually pivoting the hopper and cover plate therewith. A pusher plate is connected to the actuator and mounted in the hopper for pushing food material in the hopper into the cutter. A hopper cover plate is fixed to the housing and covers the otherwise open hopper when it is in the second position in alignment with the cutter. The actuator is mounted to the hopper for both sliding movement toward and away from the housing and pivotal movement with the hopper toward and away from the cutter.

7 Claims, 6 Drawing Figures

FOOD MATERIAL SLICING MACHINE

BACKGROUND OF THE INVENTION

1. Field of the Invention

The present invention relates to a food material slicing machine and, more particularly, to an improved means of feeding material from a hopper to a cutter which slices or shreds the material.

2. Prior Art

In order to reduce the possibility of injury to the hands of an individual utilizing a food material slicing machine, it has been common practice to provide some sort of housing surrounding the cutter, with a hopper connected to the housing and having a hinged door for providing a passage through which the food material to be sliced can be inserted and the door closed prior to the material being fed to the cutter for slicing.

Many designs have been proposed for this purpose, such as that disclosed in British Patent Specification No. 699,590. In this type of device, it is to be noted that the hopper remains stationary while upper and lower cover plates are moved back and forth over the openings in such a manner that a direct path through the hopper to the cutter is unavailable at any time.

Another device, disclosed in German Pat. No. 1,240,721, although not directly related to food material processing equipment, is of interest as having a material feed hopper which directs objects to a cutter blade. It is to be noted that this type of device has a stationary cover plate for the hopper and the hopper moves to and from a position where it can feed material to the cutter.

This latter device utilizes a pivotable feed hopper which can be rotated into a position remote from the cutter where it can be loaded with material. The feed hopper is then rotated so that the material is directed to the cutter while the hopper is shielded to prevent access through the hopper to the cutter blade. A further feed member is provided in the hopper to force the material out of the hopper into the cutter.

It is to be noted that the additional feed member has a pivot point which is eccentric from that of the pivot point of the feed hopper, and that operation of the device requires the operator to first move the hopper into its position adjacent the cutter and then to rotate the feed member to empty the hopper. This would appear to require the operator to relieve positive control of the hopper in order to operate the feed member, or require the use of both hands in order to hold the hopper in position while moving the feed member to clear the hopper.

SUMMARY OF THE INVENTION

The present invention overcomes the above described difficulties and disadvantages associated with the prior art devices by providing a food material slicing machine in which the food material receiving hopper can be moved between a position wherein food material can be placed in the hopper and a position adjacent to a cutter where the food material in the hopper can be forced into the cutter for slicing, while having covers which prevent direct access to the cutter during operation.

Also, the food material receiving hopper of the slicing machine advantageously provides a generally elongated horizontally disposed trough within which certain fruits and vegetables, such as oranges, celery and carrots, may be placed in a desired orientation with respect to the cutting plane of the cutter and then guided along a rectilinear path into the cutter when pushed by a pusher plate so as to be properly sliced.

For example, in prior art devices where the feed trough is arcuate, such as is illustrated in FIG. 3 of the British patent mentioned above, or where the feed trough is vertical and opens onto a horizontal blade, such as is illustrated in FIG. 4 of the British patent, vegetables such as carrots and celery will not stay properly aligned relative to the cutter to provide the desired cut perpendicular to the length of the vegetables. In the present invention, however, such vegetables can be placed in the hopper and set against the pusher plate which will then maintain pressure on them as they are fed to the cutter and thus maintain them in proper alignment for transverse cutting.

Likewise, citrus, such as oranges and lemons, which are preferably sliced across their segments, are generally very difficult to keep properly aligned relative to the cutter in prior art devices, such as those mentioned above, since they tend to roll through the feed trough or hopper toward the cutter and thus become disoriented. In the present invention, the citrus can be placed in the hopper in proper orientation and maintained in that orientation as the hopper is moved to the cutter.

The machine of the present invention is provided with a housing, a cutter mounted in the housing, a hopper pivotally mounted to the housing for receiving food material, such as vegetables, nuts, fruit. cheese or the like, to be sliced, when the hopper is in a first position remote from the cutter, and pivotable to a second position in alignment with the cutter so that the food material in the hopper can be fed to the cutter. A cutter cover plate is also pivotally mounted to the housing for movement with the hopper for covering the cutter when the hopper is in the first position, where it is loaded with food material, and for uncovering the cutter when the hopper is moved to the second position in alignment with the cutter. The cutter cover plate is preferably rigidly interconnected with the hopper for simultaneous pivotal movement with the hopper.

A pusher plate is mounted in the hopper for sliding movement toward and away from the cutter for pushing food material in the hopper into the cutter. An actuator is mounted to the hopper and connected to the pusher plate in the hopper for moving the pusher plate toward and away from the housing containing the cutter. Also, the actuator may be used for causing the pivotal movement of the hopper between its filling position and the cutter position. A hopper cover plate is mounted to the housing and covers the otherwise open hopper when it is aligned with and adjacent the cutter, but terminates short of the position of the hopper when it is being filled.

The actuator includes a handle fixed to a slide member which is slidably mounted on a rod fixed to the hopper. The slide member is also fixed to the pusher plate so that movement of the handle in a direction perpendicular to the pivotal axis of the hopper moves the hopper into position for filling or into position in alignment with the cutter. Movement of the handle parallel to the axis of rotation of the hopper causes movement of the pusher plate toward and away from the housing and cutter. Thus, in the preferred embodiment, a single handle is utilized for performing all necessary motions from positioning the hopper for filling to feeding the food material from the hopper into the cutter.

In its preferred form, the food material slicing machine of the present invention is associated with a vertically disposed cutter, although, with slight modifications, it could be utilized with a horizontally or angularly disposed cutter. With a vertically disposed cutter, the hopper and cutter cover plate are pivoted about a horizontal axis. As a result, the hopper describes an arcuate path and thus the hopper cover plate is of similar arcuate form so that when the hopper moves from the filling position, located just beyond the edge of the hopper cover plate, to a position in alignment with the cutter, it is completely covered by the hopper cover plate.

DETAILED DESCRIPTION OF THE PREFERRED EMBODIMENT

Figure 1:
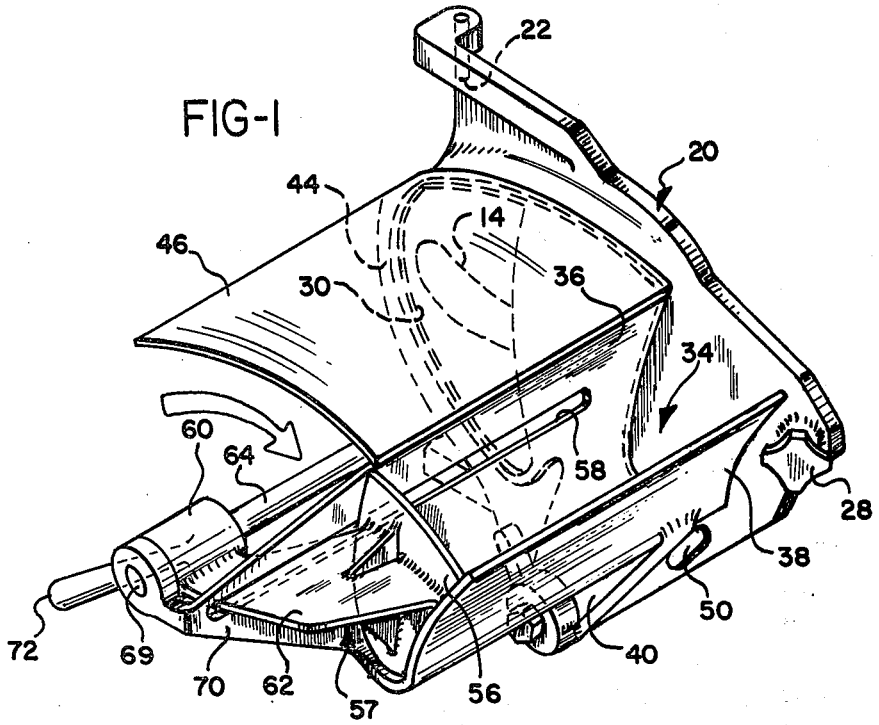
FIG. 1 is a pictorial view of the device of the present invention without the associated cutter and housing.
Figure 2:
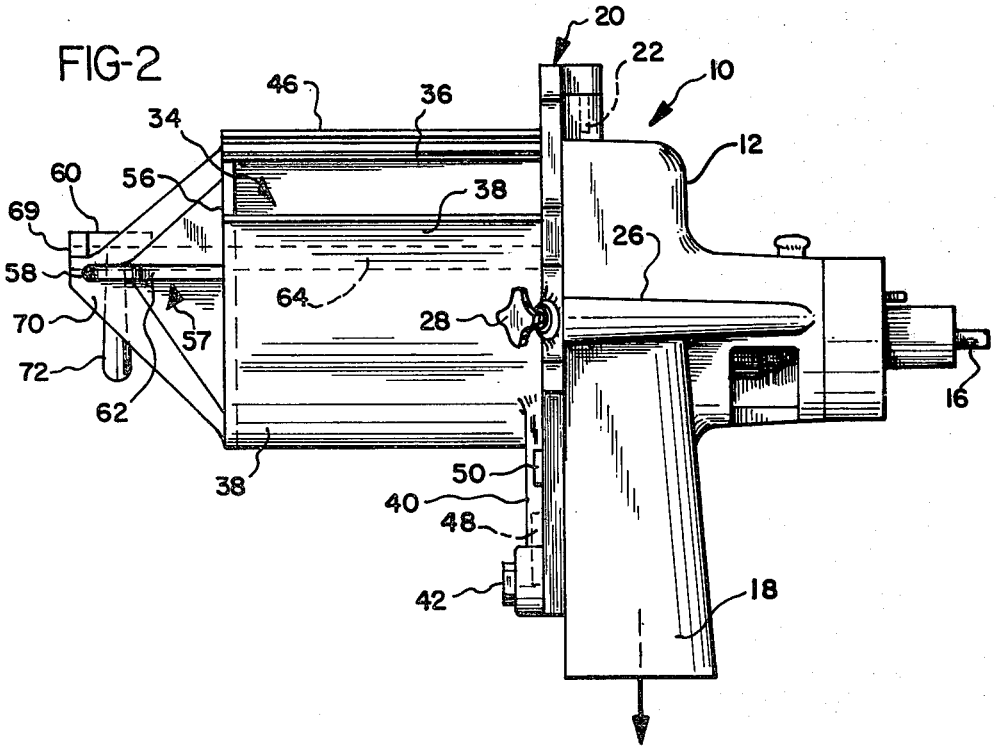
FIG. 2 is a side view with the device positioned on a typical cutter and associated housing and drive mechanism.

The food material slicing machine of the present invention, shown generally at 10 in FIG. 2 as an attachment adapted to work with the power take-off of a food preparation machine, includes a support housing 12 which supports slicing means, such as a vertically disposed rotatable cutter 14 (FIG. 1). The cutter 14 may take any of several forms, such as a cutter plate, a knife and gauge plate, a grater plate, a rasper plate or the like.

A power input shaft 16 (FIG. 2) is rotatably supported in the housing 12 for rotating cutter 14 when the exposed end of the shaft is connected to the power take-off drive (not shown) of a food preparation machine. The cutter 14 is mounted in an internally open portion of the support housing 12 above an output chute 18 through which the sliced food material is discharged.

Figure 3:
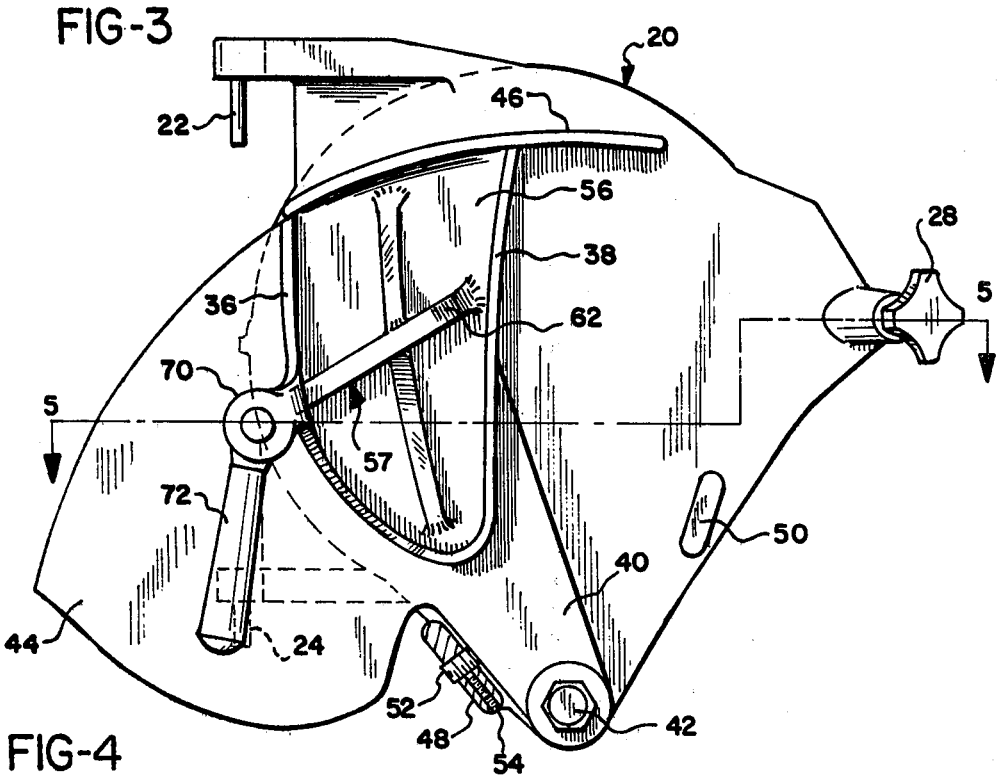
FIG. 3 is an elevational view of the preferred embodiment of the present invention without the cutter and its surrounding housing.
Figure 4:
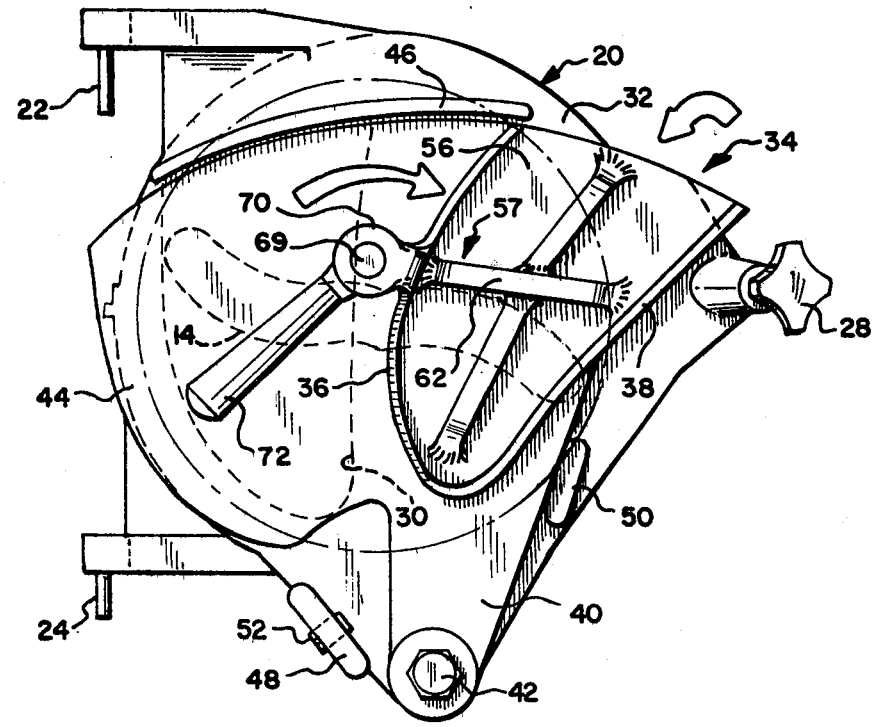
FIG. 4 is a view similar to FIG. 3 with the hopper displaced laterally and an exemplary cutter illustrated in phantom.

The food material slicing machine 10 includes a front housing 10 which is pivotally supported by pins 22 and 24, as best seen in FIGS. 3 and 4, which are securely mounted to hinge extensions on the housing 20 and rotatably fit in corresponding holes in hinge extension on the housing 12 so that the front housing 20 can be pivoted about a vertical axis defined by pins 22 and 24 to open the machine for cleaning or changing the cutter 14. A latching mechanism 26 (FIG. 2) is provided which retains the front housing 20 in position against the housing 12 during use of the device, and permits the front housing to be swung open.

The latching mechanism 26 is operated by rotating a handle 28. A clutch (not shown) disposed within the housing 12 engages the input shaft 16 with the cutter 14 by rotating handle 28 and disengages the input shaft 16 from the cutter 14 by counterrotation of the handle 28, so that the cutter is disengaged from the input shaft 16 when the front housing 20 is opened to expose the cutter 14.

The front housing 20 defines an opening 30 which opens onto the cutter 14 through approximately half of its travel, as shown in FIG. 4. The food material to be processed is fed through this opening 30 to the cutter 14 for slicing, grating, dicing or the like. The housing 20 provides a cover 32 over the remaining portion of the cutter 14.

The food material slicing machine 10 also includes a hopper 34 defined by walls 36 and 38 which are curved and joined to form a generally elongated trough having U-shaped vertical cross section shape which extends horizontally out from the housing 20. The hopper 34 is supported by, and preferably integrally formed with, an arm 40 pivotally mounted at its lowermost end portion by bolt 42 to the housing 20 so that it can be pivoted laterally between the two positions illustrated in FIGS. 3 and 4. The cross sectional shape of the hopper 34 formed by walls 36 and 38 conforms generally to the configuration of the opening 30 in the housing 20 so that food material in the hopper 34 can be fed to the cutter 14 when the hopper is positioned in alignment with the opening 30.

Also integrally formed with the arm 40 and walls 36 and 38 is a cutter cover plate 44 which has its outer periphery contoured to cover the opening 30 when the arm 40 is pivoted to the position for filling the hopper 34, as illustrated in FIG. 4. Cover plate 44 is flat and is in closely spaced relation to the front surface of housing 20.

A hopper cover plate 46 is integrally formed with housing 20 and extends generally horizontally outward from the housing 20 to an extend substantially equal to the length of the hopper 34, as shown in FIG. 1. Hopper cover plate 46 has an arcuate shape in vertical cross section, corresponding to the path of movement of the upper end portions of walls 36 and 38 forming the hopper 34. The axis of the radius of curvature of the cover plate 46 is coaxial with the pivotal axis of the hopper 34 so that as the hopper is moved between the positions illustrated in FIGS. 3 and 4 the hopper cover plate is in closely spaced relation to the opening in the top of the hopper 34 until the hopper has moved to the filling position of FIG. 4. At this location, the hopper cover plate 46 terminates adjacent the upper edge of wall 36 so that the top of the hopper is completely open for filling.

As the hopper is rotated in the opposite direction to the position in alignment with the cutter, as illustrated in FIG. 3, the hopper progressively becomes covered by the hopper cover plate 46. Thus, when the hopper 34 is moved to the position in alignment with the opening 30 it is completely covered by the hopper cover plate 46 to prevent access through the top of hopper 34 to the cutter 14.

A pair of limit stops 48 and 50 are mounted to or integrally formed with the housing 20 at positions where they will contact the side portions of arm 40 at each end of its path of pivotal movement from the position shown in FIG. 3, in alignment with the opening 30, and its position shown in FIG. 4 where the hopper 34 can be filled. An adjustment screw 52 is provided in each limit stop 48 and 50 to permit a slight amount of adjustment in the pivotal movement of arm 40 to allow for more precise alignment of the hopper with the opening 30 and the edge of hopper cover plate 46. A set screw 54 is likewise provided in each to lock the adjustment screw 52 in a desired position.

Fitted into the hopper 34 is a pusher plate 56 having substantially the same peripheral contour as the cross section of the hopper formed by the walls 36 and 38. As will be described hereinafter, the pusher plate 56 is mounted on an actuator, which includes a slide member 57 for generally rectilinear movement in the hopper between the positions shown in FIGS. 5 and 6 so that food material can be placed into the hopper when the pusher plate is in the position illustrated in FIG. 6, and then can be fed into the cutter 14 as the pusher plate approaches the position illustrated in FIG. 5. The side wall 36 of hopper 34 is provided with a slotted opening 58, as best seen in FIG. 1. The slide member 57 includes a cylindrical outer end portion 60 and a pusher plate support bracket 62. The pusher plate bracket 62 is secured to or integrally formed with the pusher plate 56 and extends laterally outward through the slotted opening 58 where it connects with the cylindrical outer and portion 60 which has a horizontally extending hole therethrough.

Figure 5:
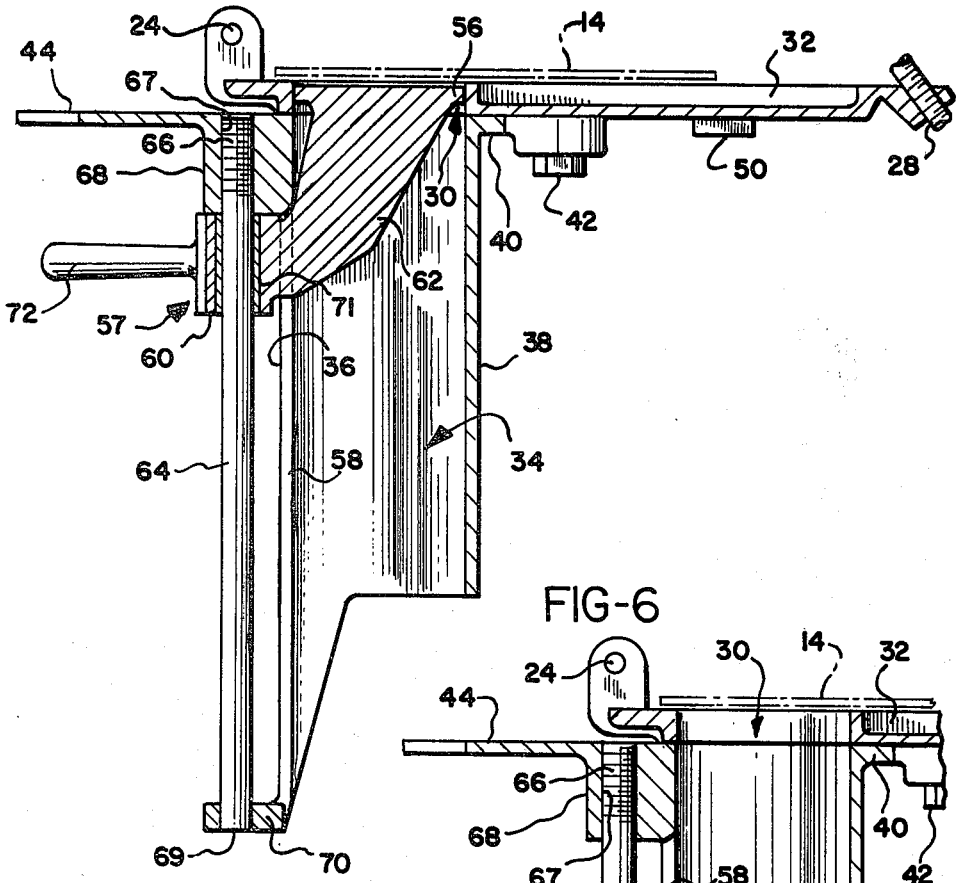
FIG. 5 is a cross sectional view along line 5—5 of FIG. 3, illustrating the pusher plate immediately adjacent the cutter.
Figure 6:
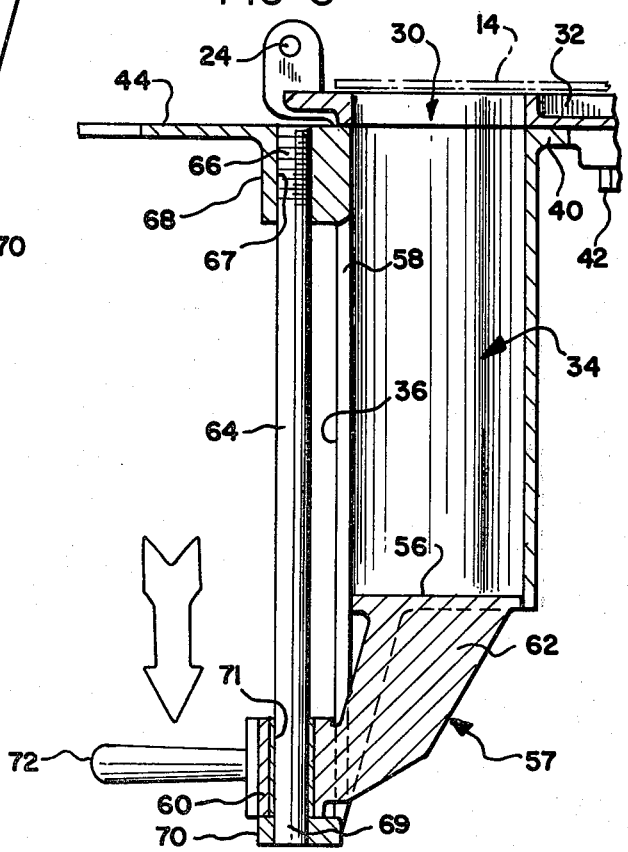
FIG. 6 is a view similar to FIG. 5, illustrating the pusher plate in its position remote from the cutter.

For slidably mounting the slide member 57, the actuator further includes a support rod 64 provided adjacent the hopper's slotted opening 58 and supported at its innermost end by cover plate 44, such as by threading the end portion 66 of rod 64 into a hole 67 in a shoulder 68 on the cover plate 44. The outermost end 69 of rod 64 is supported in a bracket extension 70 of side wall 36 of hopper 34 so that the rod is rigidly supported at both ends. The rod 64 extends through and slidably mounts the slide member 57 at its cylindrical portion 60 which can be provided with a bushing 71 so that the pusher plate 56 attached to the slide member 57 can slide easily along the rod 64 for movement of the pusher plate 56 between its extreme positions as shown in FIGS. 5 and 6.

Finally, the actuator includes a handle 72 formed integrally with or otherwise connected to the cylindrical portion 60 of the slide member 57. The handle 72 provides a convenient grip for moving the pusher plate within the hopper both toward and away from the cutter 14, and for pivoting the hopper laterally about bolt 42 between the food material feed position, shown in FIG. 3, and the hopper loading position, shown in FIG. 4.

In operation, the hopper 34 is first moved to the food material loading position at which arm 40 contacts limit stop 50 and the top of the hopper is open, as illustrated in FIG. 4, where the material to be processed is introduced into the hopper. Prior to the introduction of the food material into the hopper in this location, the pusher plate 56 is moved outward to the outer end of the hopper 34 where it provides an outer end closure for the hopper 34.

If, for example, citrus, such as oranges or lemons, are to be sliced, they are first layed in the hopper in proper orientation and then the pusher plate 56 is brought forward to bear lightly against the citrus and hold the forward most against the cover 32 to maintain alignment of the citrus as the hopper is moved into alignment with opening 30. After being loaded with food material, the hopper is then pivoted about bolt 42 in the counterclockwise direction by pulling on handle 72 until the arm 40 contacts the limit stop 48 where the hopper is in alignment with the opening 30 in housing 12, as shown in FIG. 3. The handle 72 is then pushed toward the cutter 14, causing the pusher plate 56 to force the food material into the cutter for processing.

It can be seen that the operation of the food slicing machine of the present invention can be simply accomplished with one hand, which in the illustrated embodiment is the left hand, so that the right hand is free for loading food material into the hopper. This is thus no need for releasing the handle 72 in order to place food material in the hopper, which enhances the efficiency of the present invention. Likewise, when slicing citrus, it is not necessary to stop the cutter to place the first one against it, as in the case with most prior art machines, since, as mentioned above, the citrus can be properly aligned in the hopper and held against the cover 32 as the hopper is moved to the cutting position while the blade is still active.

While the form of apparatus herein described constitutes a preferred embodiment of this invention, it is to be understood that the invention is not limited to these precise forms of apparatus, and that changes may be made therein without departing from the scope of the invention.

What is claimed is:

1. A food material slicing machine having a housing with an open bottom, a vertical cutter mounted in the housing for rotation on a horizontal axis, a stationary cutter cover lying in a vertical plane parallel to and closely adjacent said cutter and having an opening therein exposing a portion of said cutter to enable passage through the opening of food such as fruits and vegetables to be cut, characterized in that:

a hopper extending horizontally outwardly from the cutter cover is pivotally mounted on the cover on an axis below and parallel to the axis of rotation of the cutter, the hopper having a bottom and side walls but being open throughout its length on the top side thereof for receiving food material to be cut and further having an open discharge end adjacent said cutter cover, the pivotal axis for the hopper enabling the hopper to be moved laterally between a first position in which the discharge end of the hopper is remote from the opening in the cover and a second position wherein the discharge end of the hopper aligns with the opening so that food material in the hopper can be pushed through the opening toward the cutter, a cutter cover plate mounted for movement with the hopper to cover the opening when the hopper is in the first position, a pusher plate mounted in the hopper for horizontal movement between a first position at the end of the hopper remote from the cutter and a second position at the discharge end of the hopper to urge food material through the opening, and a hopper cover plate extending the full length of the hopper and mounted on the cutter cover in a position to expose the top open side of the hopper when the hopper is in the first position and to cover the open side of the hopper when it is in its second position.

2. A food material slicing machine as claimed in claim 1, including an actuator connected to the pusher plate and mounted to the hopper for causing generally rectilinear movement of the pusher plate along the hopper toward and away from the housing.

3. A food material slicing machine as claimed in claim 2, wherein the hopper, cutter cover plate and actuator are interconnected for simultaneous movement about a common axis.

4. A food material slicing machine as claimed in claim 2 or 3 wherein the actuator includes a handle, a rod fixed to the hopper, and a slide member slidably mounted on the rod and, in turn, mounting the handle and the pusher plate whereby movement of said handle moves the pusher plate in the hopper toward or away from the housing.

5. A food material slicing machine as claimed in claim 1, 2, or 3 wherein the cutter cover plate is fixed to the hopper for pivotal movement therewith whereby the cutter cover plate covers the cutter when the hopper is in the first position, for filling, and is pivoted to uncover the cutter as the hopper is moved to the second position in alignment with the opening in the cutter cover.

6. A food material slicing machine as claimed in any of the claims 1–3 wherein the hopper cover is arcuate with the axis of its radius of curvature coaxial with the pivotal axis of the hopper so as to cover the top of the hopper at least when it is in the second position in alignment with the opening in the cutter cover.

7. A food material slicing machine as claimed in claim 6 wherein the direction of rectilinear movement of the actuator and pusher plate toward and away from the housing is generally perpendicular to the direction of pivotal movement of the hopper toward and away from the cutter.

* * * * *